United States Patent [19]

Nishimura et al.

[11] 3,953,963

[45] May 4, 1976

[54] ELECTRONIC DIGITAL DISPLAY TIMEPIECE CORRECTION DEVICE

[75] Inventors: Izuhiko Nishimura; Masuo Tsuji, both of Suwa, Japan

[73] Assignee: Kabushiki Kaisha Suwa Seikosha, Suwa, Japan

[22] Filed: Aug. 9, 1974

[21] Appl. No.: 496,250

[30] Foreign Application Priority Data

Aug. 9, 1973 Japan ..... 48-89481

[52] U.S. Cl. ..... 58/23 R; 58/85.5

[51] Int. Cl.[2] ..... G04C 3/00

[58] Field of Search ..... 58/23 R, 50 R, 85.5

[56] References Cited

UNITED STATES PATENTS

| | | | |
|---|---|---|---|
| 3,672,155 | 6/1972 | Bergey et al. | 58/50 R |
| 3,699,763 | 10/1972 | Zeph | 58/23 R |
| 3,810,356 | 5/1974 | Fujita | 58/85.5 X |
| 3,823,551 | 7/1974 | Riehl | 58/23 BA X |
| 3,852,950 | 12/1974 | Yoda et al. | 58/85.5 X |

*Primary Examiner*—L. T. Hix
*Assistant Examiner*—U. Weldon
*Attorney, Agent, or Firm*—Blum, Moscovitz, Friedman & Kaplan

[57] ABSTRACT

An electronic digital display timepiece having a locking switch to prevent inadvertent correction of the timepiece, the locking switch being adapted to effect setting of at least one of the digits of time displayed. The electronic timepiece includes a quartz crystal oscillator circuit for producing high frequency time standard signals and a divider circuit including a plurality of divider stages adapted to produce low frequency timekeeping signals in response to said high frequency time standard signals. A display is associated with each of the plurality of divider stages in order to display digits of time in response to the low frequency timekeeping signals counted thereby. The count of certain of the divider stages may be corrected by correction switches provided a locking switch is first displaced from a locking mode to release mode. The locking switch is coupled to at least one divider stage not having a correction switch coupled thereto through circuitry effecting a setting of the divider stage by the operation of said locking switch.

12 Claims, 7 Drawing Figures

FIG. 1
PRIOR ART
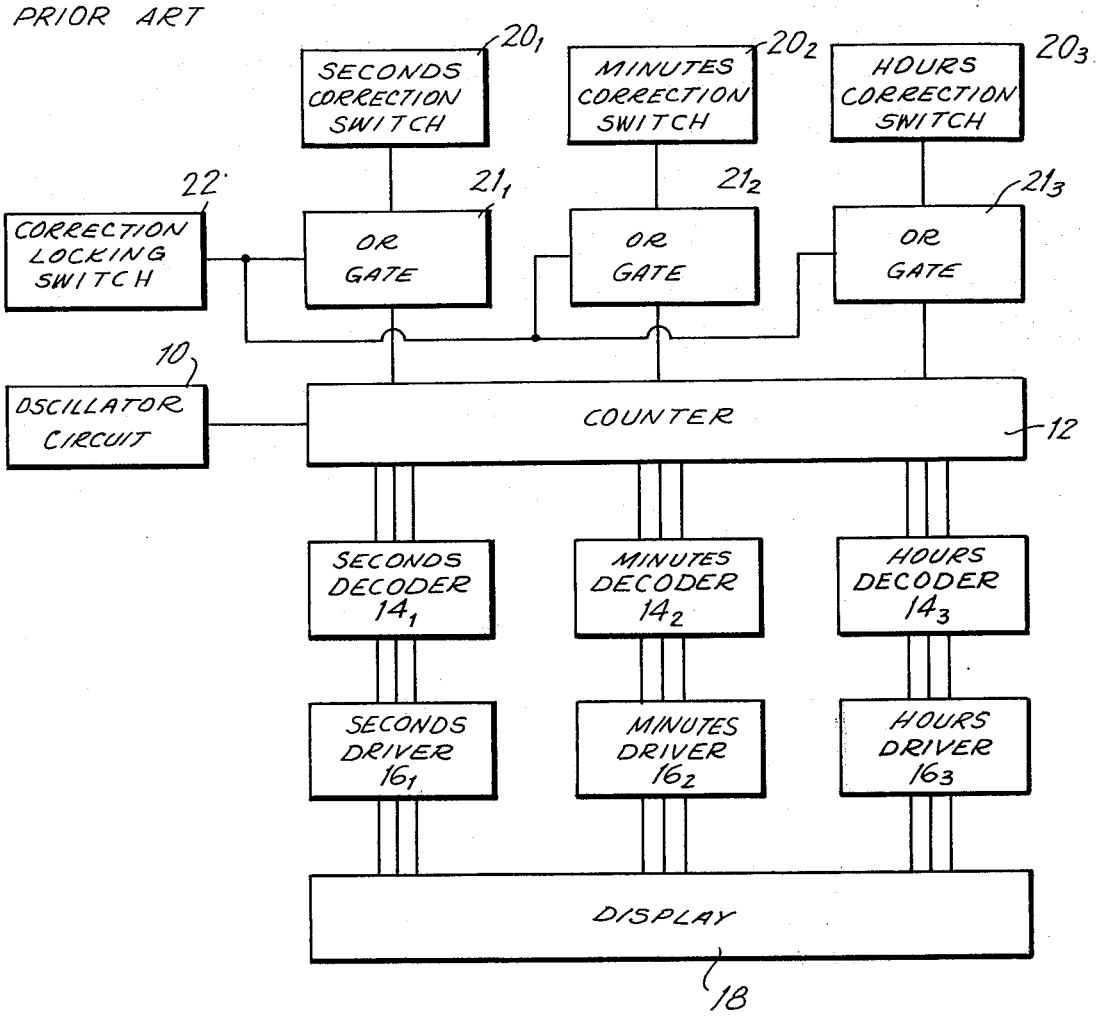
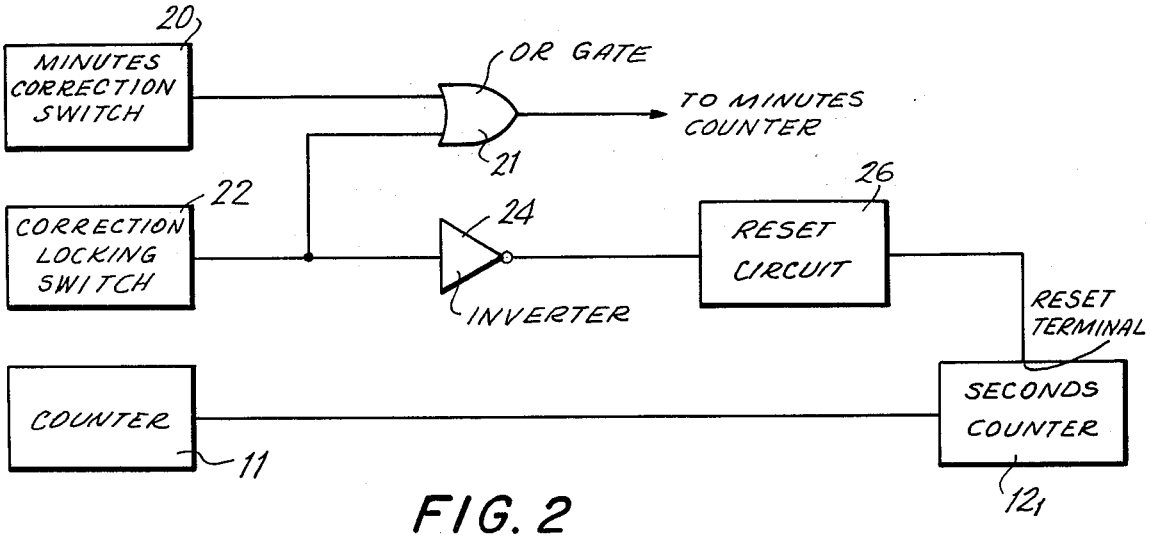
FIG. 2

ELECTRONIC DIGITAL DISPLAY TIMEPIECE CORRECTION DEVICE

BACKGROUND OF THE INVENTION

This invention relates in general to an electronic digital display timepiece, and in particular to a digital display electronic wristwatch having an improved correction circuit with a locking switch for preventing inadvertent correction.

Electronic digital display timepieces, namely, timepieces wherein a liquid crystal or light emitting diode display effects the display of actual time in response to timekeeping signals generated by electronic circuitry, are gaining wide popularity. As the manufacture and sale of such timepieces increases, correction circuits for easily and accurately correcting such electronic timepieces utilizing the minimum number of correction switches possible is desired. Approaches for minimizing the number of switches can fall into four general categories.

The first category is the deactivation of the seconds counter in the wristwatch when a button switch is pressed, or a crown is pulled out, the counter being restarted after each of the other digits in the timepiece is corrected. A second approach is the setting of each of the counters at zero when the crown is pulled out to thereby enable the correcting of each digit, the pushing in of the crown after correction restarting the counters.

A third approach which is similar to the above-noted approach is to allow the circuitry to continue counting when the crown or other like actuating mechanism is pulled out. Once the hour and minute digits are corrected, and the crown is pushed in to restart the mechanism, the mechanism instantly resets the seconds counter to zero and the movement begins counting. When such an approach is utilized the smallest unit of time displayed by the timepiece, such as seconds or hundreds of seconds, namely the display corresponding to the shortest period of time is reset to zero.

Finally, a variation on the above-noted methods is to reset the seconds counter to zero at the time that the crown or other like correcting mechanism is pulled out thereby causing the digit to be reset to zero instantaneously at the beginning of correction and then to correct the other digits, the seconds counter continuing to count during correction of the other digits.

Because correction of electronic timepieces is usually done by listening to a reference signal such as an announcement of time, each of the approaches detailed above is aimed at setting to zero the seconds counter and allowing same to begin counting at the reference time.

A disadvantage of electronic timepieces is that unlike mechanical display timepieces wherein the correction of time is performed by pulling out the crown and rotating same, electronic display wristwatches include push buttons or other manually operated switches which are associated with the digits of time to be displayed to thereby allow each manually operated switch to be used for the individual correction of the incorrect digits of time. Accordingly, because such push buttons and other manually operated switches are likely to be inadvertently actuated, it is necessary to provide a locking switch to protect against accidental or inadvertent correction when same is not needed.

SUMMARY OF THE INVENTION

Generally speaking, in accordance with the invention, an electronic digital display timepiece wherein the number of correction switches is reduced, and inadvertent correction is eliminated by a locking switch is provided. The electronic timepiece includes a quartz crystal oscillator circuit for producing high frequency time standard signals and a divider circuit including a plurality of divider stages adapted to produce low frequency timekeeping signals in response to the high frequency time standard signal. Display elements are associated with the plurality of divider stages to thereby display digits of time in response to the low frequency timekeeping signals. Correction switch means including a correction switch associated with certain of said divider stages for producing a correcting signal to each of said certain divider stages producing timekeeping signals. A locking switch is coupled to each of the certain divider stages the locking switch being adapted to be released from a locking mode to a release mode to thereby permit the selective correction of the count of the certain divider stages by the correction switches associated therewith. The locking switch includes circuit means for setting the count of at least one of the divider stages not having a correcting switch associated therewith in response to the operation of the locking switch.

Accordingly, it is an object of this invention to provide an improved electronic digital display timepiece having a reduced number of correction switches.

Still another object of this invention is to provide an improved electronic digital display timepiece wherein correction is achieved by a reduced number of correction switches and inadvertent correction is avoided by the use of a locking switch.

Still another object of this invention is to provide an improved electronic timepiece wherein the seconds display is set to zero by the return of the locking switch to a locking position.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block circuit diagram of a digital display electronic timepiece constructed in accordance with the prior art;

FIG. 2 is a block circuit diagram of an electronic digital display timepiece including a correction-locking circuit constructed in accordance with the instant invention;

DETAILED DESCRIPTION OF THE PREFERRED EMBODIMENTS

Reference is now made to FIG. 1, wherein an electronic digital display electronic timepiece having a correction-locking switch constructed in accordance with the prior art is depicted. A quartz crystal oscillator circuit 10 is adapted to provide a high frequency clock signal to a counter circuit 12 including a plurality of series-connected divider stages of the type shown and described in U.S. Pat. No. 3,717,990, and adapted to produce timekeeping signals representative of actual time in response to the clock signals produced by oscillator circuit 10. Seconds decoder $\mathbf{14_1}$, minutes decoder $\mathbf{14_2}$ and hours decoder $\mathbf{14_3}$ are respectively coupled to the divider stages producing timekeeping signals in response thereto are adapted to respectively apply decoded seconds, minutes, and hours signals to seconds driver $\mathbf{16_1}$, minutes driver $\mathbf{16_2}$ and hours driver $\mathbf{16_3}$, respectively, which drivers in turn effect a driving of the individual display elements (not shown) of digital display 18.

In order to effect correction of any of the digits of time displayed by the display elements, seconds correction switch $\mathbf{20_1}$, minutes correction switch $\mathbf{20_2}$ and hours correction switch $\mathbf{20_3}$ are respectively coupled to the corresponding divider stage through OR circuits $\mathbf{21_1}$, $\mathbf{21_2}$ and $\mathbf{21_3}$. A correction locking switch 22 is coupled as the other input to each of the OR circuits $\mathbf{21_1}$, $\mathbf{21_2}$ and $\mathbf{21_3}$ and provides a gate control signal to the OR circuit, the potential or logic state of the control signal determining if a selectively applied correction signal from any of the correction switches is to be applied to the divider stage associated therewith.

Accordingly, four switches are required in order to effect the correction of the three separate divider stages producing timekeeping signals representative of actual time and a fourth switch is required as the locking switch. It is noted that if the date and day of the week are included in a digital timepiece, it is necessary to add two further switches therefor. The more switches that are added in a small-sized wristwatch, the more complex the circuitry becomes and furthermore the more awkward the appearance of the wristwatch. Accordingly, it is desired to have the correction-locking switch effect a correction of at least one of the divider stages in an electronic timepiece to thereby reduce the number of switches needed therefor.

Figure 3:
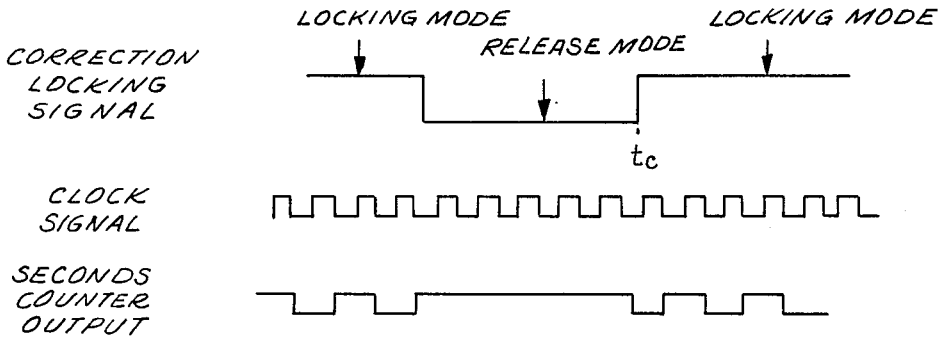
FIG. 3 is a wave diagram of the timing sequence of the correction-locking circuit illustrated in FIG. 2 during operation.

Reference is now made to FIGS. 2 and 3 wherein an electronic timepiece including a novel correction-locking circuit adapted to effect correction of the seconds counter in response to a locking of the correction switches and the wave diagram of same during operation is depicted, like reference numerals being utilized to denote like elements. By designating the higher potential side of the logic signals "H" and the lower potential side of the signal "L" and utilizing as a reference a positive logic scheme, then the correction switching signals applied by correction switches 20 are in the "L" state when the signal produced by correction locking switch 22 is in a locked mode and an "L" signal when the correction locking switch 22 is in a release mode. It is noted that the correction switch 20 is adapted to provide correction signals to minutes and hours counters but does not effect correction of the seconds counter $\mathbf{12_1}$. The second counter $\mathbf{12_1}$ is adapted to produce a one second timekeeping signal in response to a higher frequency clock signal from counter 11. For purposes of illustration the clock signal illustrated in FIG. 3 is of the type produced from a binary divider stage, but the counter 11 is not limited thereto.

In operation, the correction signal for the divider stages having correction switches associated therewith are not corrected unless the correction locking switch 22 is in a release mode to thereby provide a release mode signal "L" when the gating circuit 21 is an OR gate. Accordingly, when the correction locking switch 22 provides a release mode "L" state signal, thereby opening the OR gates 21 to the selectively applied signals from the correction switches, the counters 12 counting other than seconds are corrected. Finally, a reset circuit 26 is adapted to apply a reset signal to the reset terminal of the second counter $\mathbf{12_1}$ in response to a signal applied from an inverter 24. The inverter 24 inverts the correction locking signal applied by correction locking switch 22. After correction of each of the minutes and hours digits is effected, the correction locking switch is returned to a locking mode at a time $t_c$, the inverter circuit 24 producing a change of the locking signal from a high potential to a low potential in response to a change in the correction-locking signal from an "L" state or low potential to a high potential or "H" state. The reset circuit 26 sets the seconds counter $\mathbf{12_1}$ at a high potential and thereby the count thereof to zero and prevents same from counting when the correction-locking switch is in a release mode. Accordingly, at a time $t_c$ when the correction switch is returned from a release mode to a locking mode, the inverter circuit 24 supplies a logic signal of a low potential to the reset circuit thereby releasing the seconds counter $\mathbf{12_1}$ and allowing same to begin counting to thereby provide a one second timekeeping signal output.

It is therefore noted that a seconds correction switch is not needed since the termination of the correction of the electronic timepiece will occur when the correction locking switch is returned to a locking mode and the return of the correction switch to such locking mode will affect a restart of the seconds counter coincident therewith.

Figure 4:
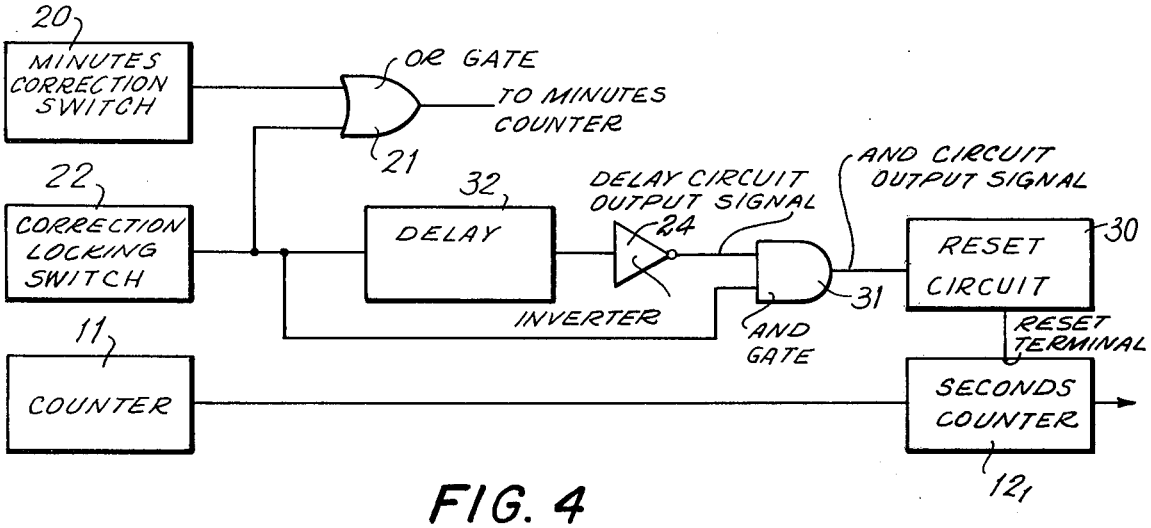
FIG. 4 is a block circuit diagram of another embodiment of the correcting-locking circuit constructed in accordance with the instant invention.
Figure 5:
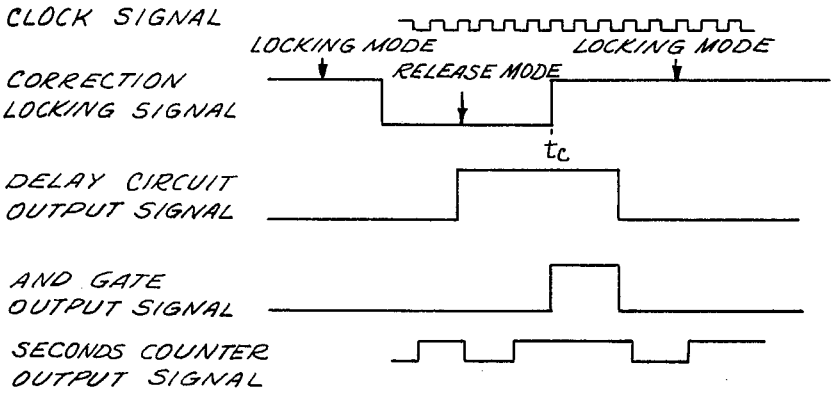
FIG. 5 is a wave diagram of the timing sequence of the circuit depicted in FIG. 4, in operation.

Reference is now made to FIGS. 4 and 5, wherein another embodiment of the correction-locking circuit constructed in accordance with the instant invention is depicted, like reference numerals being utilized to denote like elements. As illustrated in FIG. 4, the correction-locking signal supplied from correction locking switch 22 changes from a high to low potential when the release mode is selected. The low potential release mode correction-locking signal is thereby applied as a first input to AND gate 31. The second input to AND gate 31 is provided by a delay circuit 32 which is adapted to delay the correction-locking signal by a certain time period and apply the delayed signal to inverter circuit 24 wherein a delayed inverted output signal is supplied to AND gate 31 as the other input thereof. The output of the AND gate thereby provides a high potential reset signal to reset circuit 30, the output signal from AND gate 31 having a period equal to the delay provided by delay device 32, the count of the seconds counter being reset at the time $t_c$ and at a time after $t_c$ equal to the period of the delay, begins counting and produces one second timekeeping signals. Thus, counting of the seconds counter $12_1$ is effected.

Figure 6:
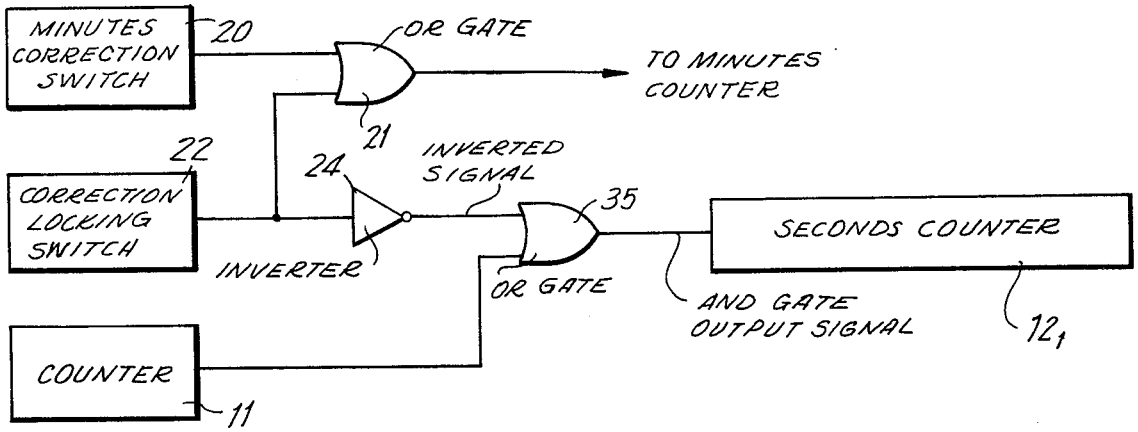
FIG. 6 is a block circuit diagram of another embodiment of the correction-locking circuit constructed in accordance with the instant invention.
Figure 7:
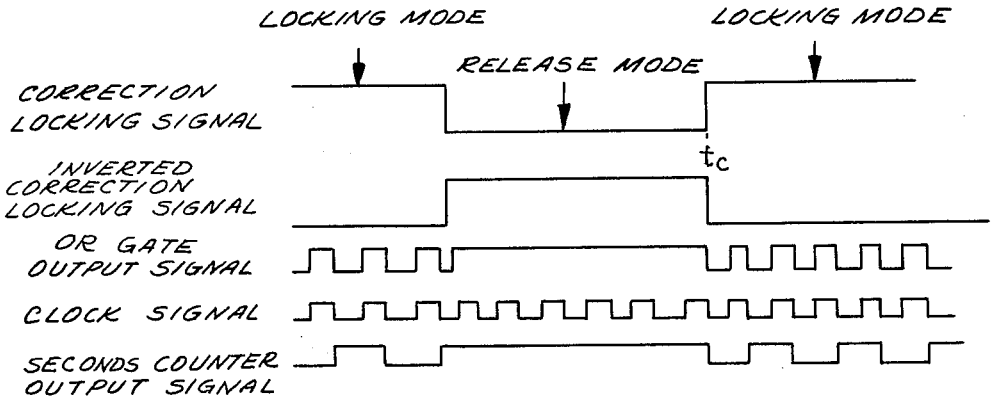
FIG. 7 is a wave diagram of the timing sequence when the correction-locking circuit depicted in FIG. 6 is in operation.

Reference is now made to FIGS. 6 and 7 wherein still another embodiment of the correction-locking circuit constructed in accordance with the instant invention is depicted, like reference numerals being utilized to denote like elements. In the embodiment illustrated in FIG. 6, the inverted signal produced by inverter 24 is applied to an OR gate 35, the inverter signal being utilized to gate the clock signal from binary divider stage 11. Accordingly, in response to a high potential signal produced by the inverter in response to a low potential release mode signal from the correction-locking switch, OR gate 35 supplies an inhibit signal to the seconds counter $12_1$ to thereby inhibit seconds counter $12_1$ from counting until the correction-locking switch is returned to a locking mode.

It is noted that in each of the locking-correction circuits noted above, the correction locking switch effects a correction of the seconds counter thereby simplifying an electronic digital electronic timepiece by reducing the number of switches therein. Moreover, by providing for the restarting at zero of the seconds divider stage, such a correction circuit promotes a reliable and accurate timepiece capable of being set by listening to a reference signal. It is further noted that any divider stage or counter producing timekeeping signals can be set to zero by utilizing the above-mentioned invention. For example, if the timepiece only includes minutes and hours it would be possible to utilize a locking switch to reset the minutes counter to zero. Furthermore, this concept is adapted for use in highly accurate timepieces wherein the counter producing the highest frequency timekeeping signal such as 1/10 of a second or 1/100 of a second can be utilized to achieve such accurate correction.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece having a quartz crystal oscillator circuit producing a high frequency time standard signal a divider circuit including a plurality of divider stage means adapted to produce low frequency timekeeping signals in response to said high frequency time standard signal, and display means associated with said plurality of divider stage means to display digits of time in response to said low frequency timekeeping signals, correction means including a plurality of correction switch means associated with certain of said plurality of divider stage means producing timekeeping signals, the improvements comprising locking switch means coupled intermediate each said correction switch means and each of said divider stage means having a correction switch means associated therewith, said locking switch means being adapted to be operated from a locking mode to a release mode to thereby permit the selective correction of the count of said certain divider stage means by said correction switch means associated therewith, said locking switch means being coupled to at least one of said divider stage means not having a correction switch means associated therewith for controlling the operation of said divider stage means by the operating of said locking switch means between a release mode and a locking mode.

2. An electronic timepiece as claimed in claim 1, wherein said locking switch means controlling function is to adjust to zero the count of the said at least one divider stage not having a correction switch means associated therewith by the operation of said locking switch means from said release mode to said locking mode.

3. An electronic timepiece as claimed in claim 1, wherein said at least one divider stage means not having a correction switch means associated therewith produces the highest frequency timekeeping signal displayed by said digital display means.

4. An electronic timepiece as claimed in claim 3, wherein said locking switch means includes a gating circuit means intermediate each said correction switch means and said divider stage means associated therewith, each of said gating circuit means including as a further input one of a release mode signal and locking mode signal produced by said locking switch means, each said gating circuit means allowing selective correction of said certain divider stage means by said correction switch means associated therewith in response to said release mode signal.

5. An electronic timepiece as claimed in claim 4, wherein each of said gating circuit means is an OR gates.

6. An electronic timepiece as claimed in claim 3, wherein a reset circuit means is disposed intermediate said locking switch means and said highest frequency divider stage means, said reset circuit means being adapted to adjust the count of said highest frequency divider stage means to zero in response to the application of a release mode signal thereto from said locking switch means, said reset circuit means being further adapted to restart the count of said highest frequency divider stage means when said locking switch means is returned to said locking mode.

7. an electronic timepiece as claimed in claim 6, wherein said reset circuit means further includes an inverter means adapted to receive said locking switch means signal, said inverter being adapted to provide an actuation signal to said reset circuit means in response to a release mode signal from said locking switch means.

8. An electronic timepiece as claimed in claim 3, wherein reset circuit means includes delay circuit means disposed intermediate said locking switch means and said highest frequency divider stage means, said reset circuit means being adapted to adjust the count of said highest frequency divider stage to zero when said locking switch means is operated from a release mode to a locking mode, and is further adapted to restart the count of said highest frequency divider stage means at a time delayed by said delay circuit.

9. An electronic timepiece as claimed in claim 8, wherein said reset circuit means further includes an inverter means adapted to receive signals from said delay circuit means, said inverter means being adapted to provide an actuation signal to said reset circuit means in response to a release mode signal from said lock switch means.

10. An electronic timepiece as claimed in claim 9, wherein said reset circuit means includes an AND gate adapted to receive an inverted signal from said inverter circuit means as a first input thereto, and to receive as a second input to said AND circuit said locking switch signal, said AND gate providing an output signal to said reset circuit means having a period equal to the delay provided by said delay circuit means, at a time coincident with the operation of said locking switch means from a release mode to a locking mode.

11. An electronic timepiece as claimed in claim 1, wherein said locking switch means includes an inverter means adapted to receive one of a locking mode and release mode signals from said locking switch means, and an OR gate adapted to receive as a first input the output signal from said inverter means, and as a second input the time standard signal, and in response to a release mode signal from said locking switch means inhibit the count of said highest frequency divider stage means producing a timekeeping signal to be displayed, and in response to the operation of said locking switch means from a release mode to a locking mode to further control the highest frequency divider stage to be displayed to permit same to continue counting.

12. An electronic timepiece as claimed in claim 1, wherein the timekeeping signal produced by said certain divider stage means are timekeeping signal having periods equal to one minute and one hour, and said timekeeping signal produced by said divider stage means not having a correction switch associated therewith has a period equal to one second.

* * * * *